US010228158B2

(12) United States Patent
Liu

(10) Patent No.: US 10,228,158 B2
(45) Date of Patent: Mar. 12, 2019

(54) PTC HEATER

(71) Applicant: BESTWAY INFLATABLES & MATERIALS CORP., Shanghai (CN)

(72) Inventor: Feng Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 15/414,190

(22) Filed: Jan. 24, 2017

(65) Prior Publication Data

US 2017/0130990 A1 May 11, 2017

Related U.S. Application Data

(63) Continuation of application No. 14/676,665, filed on Apr. 1, 2015, now Pat. No. 9,618,230.

(30) Foreign Application Priority Data

Sep. 24, 2014 (CN) ..... 2014 2 05527312 U

(51) Int. Cl.
*F24H 1/10* (2006.01)
*F24H 1/12* (2006.01)
(Continued)

(52) U.S. Cl.
CPC ..... *F24H 1/102* (2013.01); *F24H 1/121* (2013.01); *F24H 9/0015* (2013.01); *F24H 9/146* (2013.01); *F24H 9/1827* (2013.01); *H05B 3/04* (2013.01); *H05B 3/44* (2013.01); *H05B 2203/016* (2013.01); *H05B 2203/02* (2013.01); *H05B 2203/021* (2013.01)

(58) Field of Classification Search
None
See application file for complete search history.

(56) References Cited

U.S. PATENT DOCUMENTS 1,820,458 A 8/1931 Jenkins
1,978,690 A 10/1934 Peterson
(Continued)

FOREIGN PATENT DOCUMENTS

CN 85201132 1/1986
CN 87212059 6/1988
(Continued)

*Primary Examiner* — Thor Campbell
(74) *Attorney, Agent, or Firm* — A J Moss; Dickinson Wright PLLC

(57) ABSTRACT

A PTC heater having a heat conductor, a first end cover, a second end cover, and a PTC heating element. The heat conductor includes a duct for accommodating a PTC heating element, a first liquid passage channel, and a second liquid passage channel. The first end cover is coupled to one end of the heat conductor and includes a first and a second compartment, a water inlet, and a water outlet. The water inlet is in fluid communication with the first compartment and the first liquid passage channel, and the water outlet is in fluid communication with the second compartment and the second liquid passage channel. The second end cover is coupled to the other end of the heat conductor. The first and second liquid passage channels are in fluid communication with each other via an internal space of the second end cover to form a closed liquid circulation channel.

14 Claims, 5 Drawing Sheets

(51) Int. Cl.

| | |
|---|---|
| ***F24H 9/00*** | (2006.01) |
| ***F24H 9/18*** | (2006.01) |
| ***F24H 9/14*** | (2006.01) |
| ***H05B 3/04*** | (2006.01) |
| ***H05B 3/44*** | (2006.01) |

(56) References Cited

U.S. PATENT DOCUMENTS

| | | | | |
|---|---|---|---|---|
| 2,419,429 | A | 4/1947 | Voiles | |
| 3,782,456 | A | 1/1974 | Gusmer | |
| 4,255,646 | A | 3/1981 | Dragoy et al. | |
| 4,334,141 | A | 6/1982 | Roller et al. | |
| 4,371,777 | A | 2/1983 | Roller et al. | |
| 4,501,952 | A * | 2/1985 | Lehrke | B05B 7/22 165/156 |
| 5,570,452 | A | 10/1996 | Kuhn et al. | |
| 5,724,478 | A | 3/1998 | Thweatt | |
| 6,093,909 | A | 7/2000 | Beetz et al. | |
| 6,330,395 | B1 | 12/2001 | Wu | |
| 7,046,922 | B1 | 5/2006 | Sturm et al. | |
| 7,088,915 | B1 | 8/2006 | Sturm et al. | |
| 7,106,957 | B2 | 9/2006 | Abras et al. | |
| 7,813,628 | B2 * | 10/2010 | Haan | F22B 1/288 392/397 |
| 8,170,406 | B2 | 5/2012 | Wu | |
| 9,618,230 | B2 | 4/2017 | Liu | |
| 2014/0050466 | A1 | 2/2014 | Giffels et al. | |
| 2014/0086566 | A1 | 3/2014 | Waechter et al. | |
| 2016/0084523 | A1 | 3/2016 | Liu | |
| 2017/0130990 | A1 | 5/2017 | Liu | |
| 2017/0130991 | A1 | 5/2017 | Liu | |
| 2017/0370614 | A1 | 12/2017 | Liu | |
| 2018/0031271 | A1 | 2/2018 | Huang et al. | |
| 2018/0031272 | A1 | 2/2018 | Huang et al. | |

FOREIGN PATENT DOCUMENTS

| | | | |
|---|---|---|---|
| CN | 2044161 | | 9/1989 |
| CN | 2059970 | | 8/1990 |
| CN | 103743088 | | 4/2014 |
| CN | 204739758 | U1 | 11/2015 |
| DE | 2948591 | A1 | 6/1981 |
| DE | 4016381 | | 12/1991 |
| DE | 4300163 | C1 | 3/1994 |
| EP | 0025916 | A1 | 4/1981 |
| EP | 0899985 | A1 | 3/1999 |
| EP | 2002687 | | 2/2009 |
| EP | 2022687 | A1 | 2/2009 |
| WO | 9831045 | | 7/1998 |
| WO | WO 2013/087671 | A1 | 6/2013 |

* cited by examiner

PTC HEATER

CROSS-REFERENCE TO RELATED APPLICATIONS

This application is a continuation application of U.S. patent application Ser. No. 14/676,665, which claims priority to Chinese Application No. 201420552731.2, entitled "PTC HEATER," filed on Sep. 24, 2014, the disclosure of which is incorporated by reference herein in its entirety.

BACKGROUND INFORMATION

1. Technical Field

The present invention relates generally to liquid heaters, and more specifically, to a positive temperature coefficient heater.

2. Background

Currently, positive temperature coefficient ("PTC") heaters are widely applied in household appliances such as spa pools, entertainment pools, water dispensers, foot baths, and other industrial products.

A PTC heater, which is commonly known in the art, includes a heat conductor, PTC heating elements, and end covers having a water inlet and a water outlet. The heat conductor includes a plurality of ducts separated from one another, where some of the ducts are used for housing PTC heating elements, and some of the ducts are used as liquid passage channels. The end covers are coupled to each axial end of the heat conductor, first serving as liquid passage channels in fluid communication with the heat conductor, and secondly serving to seal each end of the duct in which a PTC heating element is placed within the heat conductor.

A disadvantage of these types of PTC heaters lie in the fact that the entire PTC heating element, aside from wires is disposed in the duct of the heat conductor. Also, end faces of the end covers butt directly against end faces of the heat conductor, and the PTC heating element is positioned inside of the end covers. Once the end covers are sealed with the heat conductor, water permeates or leaks through the joining faces of the end covers and the heat conductor and drip on or otherwise come into contact with the PTC heating element.

Additionally, the housing of existing PTC heating elements is a tubular metal piece. A heating assembly, electrode sheets, and insulating paper are disposed within the housing, and each end of the tubular housing is sealed with rubber plugs or an insulation paste. Once the rubber plugs and the insulation paste are damaged, a gap or space is created at the ends of the tubular housing that permits water to seep into the interior of the housing. This may cause electricity to leak from the heater, resulting in an electrical short or damage to electrical components coupled to the heater.

Thus, a need therefore exists for heating unit that overcomes the disadvantages and safety risks found in currently known PTC heaters. In particular, there is a need for a PTC liquid heater that improves safety, is simple in structure, and effectively prevents electricity from leaking out of the heater.

SUMMARY

With regard to the defects presently existing in the prior art, the technical problem to be solved by the present invention is to provide a PTC liquid heater with a protective layer that improves safety, has a simple structure, and effectively prevents electrical leakage.

In order to solve the above-mentioned technical problem, there is provided a first example of an implementation of a PTC heater according to the present invention. The PTC heater includes a heat conductor, a first end cover, a second end cover, and at least one PTC heating element. The heat conductor includes at least one duct for accommodating a PTC heating element, at least one first liquid passage channel, and at least one second liquid passage channel.

The first end cover is fixedly coupled to one end of the heat conductor. The first end cover is internally provided with a first compartment, a second compartment, an end cover water inlet, and an end cover water outlet. The end cover water inlet is in fluid communication with the first compartment and the first liquid passage channel. The end cover water outlet is in fluid communication with the second compartment and the second liquid passage channel.

The second end cover is fixedly coupled to an opposite end of the heat conductor. The first liquid passage channel and the second liquid passage channel are in fluid communication with each other via an internal space in the second end cover, so as to form a closed liquid circulation channel.

The at least one PTC heating element is disposed in the duct of the heat conductor. The PTC heating element may be constructed to have a length longer than that of the heat conductor such that at least one end the PTC heating element extends out of the duct.

In some implementations, the first end cover includes at least one groove capable of accommodating the portion of the PTC heating element extending out of the duct. The groove is in communication with an external space.

In some implementations, the second end cover further includes at least one opening capable of accommodating the end of the PTC heating element extending out of the duct. In some implementations, a first sealing gasket is interposed between an end face of the first end cover and an end face of the heat conductor. The first sealing gasket surrounds a mouth formed at one end of the first liquid passage channel and a mouth formed at one end of the second liquid passage channel.

In some implementations, a second sealing gasket is also interposed between an end face of the second end cover and an opposing end face of the heat conductor. The second sealing gasket surrounds a mouth formed at an opposing end of the first liquid passage channel and a mouth formed at an opposing end of the second liquid passage channel.

In some implementations, the portion of the PTC heating element extending out of the duct is wrapped with an insulating and sealing layer. In some implementations, the insulating and sealing layer may comprise an epoxy filler, a rubber sheath, or a rubber sealing plug.

In order to solve the above-mentioned technical problem, there is further provided a second example of an implementation of a PTC heater according to the present invention. The PTC heater includes a heat conductor, a first end cover, a second end cover, and at least one PTC heating element. The heat conductor includes at least one duct for accommodating a PTC heating element, and at least one liquid passage channel.

The first end cover is fixedly coupled to one end of the heat conductor. The first end cover includes an end cover water inlet in fluid communication with one end of the liquid passage channel.

The second end cover is fixedly coupled to an opposite end of the heat conductor. The second end cover includes an end cover water outlet in fluid communication with the opposite end of the liquid passage channel.

The at least one PTC heating element is disposed in the duct of the heat conductor. The PTC heating element may be constructed to have a length longer than that of the heat conductor such that at least one end of the PTC heating element extends out of the duct.

In some implementations, the first end cover includes at least one first groove capable of accommodating the part of the PTC heating element extending out of the duct. The first groove is in communication with an external space.

In some implementations, the second end cover also includes at least one second groove capable of accommodating the portion of the PTC heating element extending out of the duct. The second groove is also in communication with the external space.

In some implementations, a first sealing gasket is interposed between an end face of the first end cover and an end face of the heat conductor. The first sealing gasket surrounds a mouth formed at an end of the liquid passage channel.

In some implementations, a second sealing gasket is interposed between an end face of the second end cover and an opposing end face of the heat conductor. The second sealing gasket surrounds a mouth formed at an opposing end of the liquid passage channel.

In some implementations, the portion of the PTC heating element extending out of the duct is wrapped with an insulating and sealing layer. In some implementations, the insulating and sealing layer may comprise an epoxy filler, a rubber sheath, or a rubber sealing plug.

Compared with PCT heating units presently in the art, the present invention has several advantages. First, PTC liquid heaters according to the present invention are mainly characterized in setting the length of the PTC heating element longer than that of the heat conductor so that at least one end of the PTC heating element is exposed out of the heat conductor. This causes the portion of the PTC heating element exposed out of the heat conductor to be located at the outer side of the joining face of the two end covers and the heat conductor. Furthermore, the present invention is characterized by providing an insulating and sealing layer on the portion of the PTC heating element exposed out of the duct, for protection, thus achieving a better insulating and sealing effect.

Compared with PCT heating units presently in the art, PTC heaters of the present invention may include a protective layer that may greatly reduce the risk of electrical leakage from the PTC heater, thereby providing high safety performance. Furthermore, PTC heaters according to the present invention provide a simple structure and can effectively prevent an electrical leakage accident and is, thus, likely to gain popularity.

BRIEF DESCRIPTION OF THE DRAWINGS

The above-mentioned and other features, properties and advantages of the present invention will become more apparent from the following description of embodiments with reference to the accompany drawings, in which.

DETAILED DESCRIPTION

Figure 1:
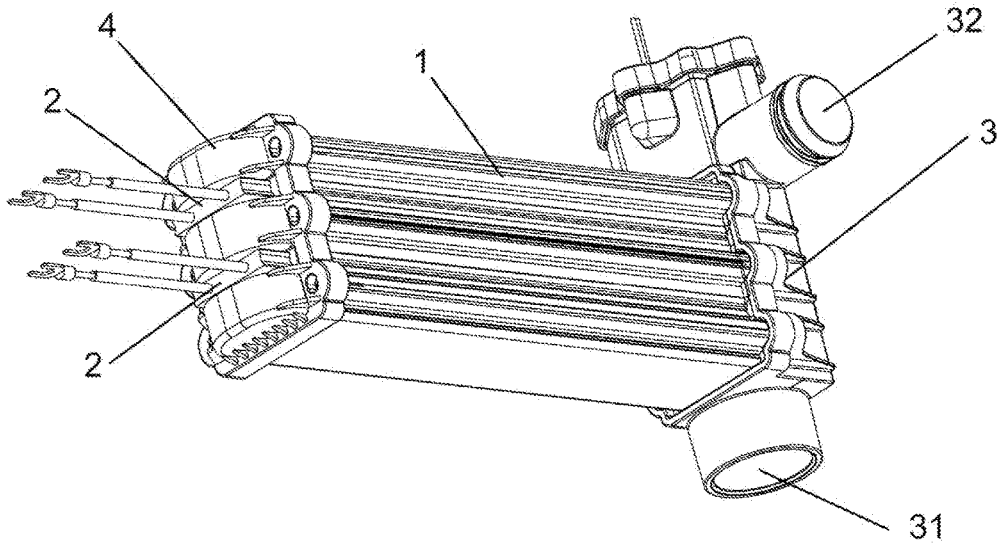
FIG. 1 is a perspective view illustrating one example of an implementation of a PTC heater according to the present invention.

The present invention will be further described below in conjunction with detailed embodiments and the accompanying drawings. More details are provided in the following detailed description in order for the present invention to be fully understood. However, the present invention can be implemented in various ways other than those described herein. A person skilled in the art can make similar analogy and modification according to the practical applications without departing from the spirit of the present invention, and therefore the contents of the detailed embodiments herein should not be construed as limiting to the scope of the present invention.

FIGS. 1-6 illustrate an example of one implementation of a PTC heater according to the teachings of the present invention. It should be noted that these and the following drawings are merely used as examples, and are not necessarily drawn to scale, and should not be construed as limiting to the scope of the present invention.

Referring to FIGS. 1-6, the PTC heater mainly includes a heat conductor 1, a first end cover 3, a second end cover 4 and at least one PTC heating element 2. The heat conductor 1 is an elongated, hollow aluminum member that includes at least one duct 11 (FIG. 2) capable of accommodating a PTC heating element 2, at least one first liquid passage channel 12 (FIG. 2), and at least one second liquid passage channel 13 for communicating liquid passing therethrough. The at least one duct 11, the at least one first liquid passage channel 12, and the at least one second liquid passage channel 13 all extend through the interior of the heat conductor 1.

The PTC heating element 2 generally includes a housing, a heating assembly, insulating paper, and two electrode sheets which are placed within the housing. The two electrode sheets are provided at opposite sides of the heating assembly. At least one layer of insulating paper wraps the electrode sheet positioned disposed outside of the heating assembly. The housing comprises a hollow aluminum tube. At least one layer of sealing plug is provided at each end of the aluminum tube. The outside of the sealing plug is filled with a sealant. PTC heating elements are well known in the art and are therefore not described in detail in the present application.

The PTC heating element 2 may be positioned within the duct 11 of the heat conductor 1 fixed, by means of cold-pressing and well butts, against an inner surface of the duct 11. In order to prevent electrical leakage due to contact between the PTC heating element 2 and a precipitant or liquid, the PTC heating element 2 may be constructed to a length that is longer than the length of the heat conductor 1 such that at least one end of the PTC heating element 2 extends out from the duct 11 of the heat conductor 1.

Two ends of the heat conductor 1 are fixedly coupled to the first end cover 3 and the second end cover 4, respectively. A first compartment 33, a second compartment 34, an end cover water inlet 31 (FIG. 1), and an end cover water outlet 32 (FIG. 1) are provided in the first end cover 3. The end cover water inlet 31 is in communication with the first compartment 33 of the first end cover 3 and the first liquid passage channel 12 of the heat conductor 1. The end cover water outlet 32 is in fluid communication with the second compartment 34 of the first end cover 3 and the second liquid passage channel 13 of the heat conductor 1. The first liquid passage channel 12 and the second liquid passage channel 13 of the heat conductor 1 are in fluid communication with each other via an internal space (FIG. 3) formed in the second end cover 4, thereby forming a closed liquid circulation channel.

When the liquid is heated, the liquid flows from the end cover water inlet 31 of the first end cover 3 into the first compartment 33, and from the first compartment 33 into the first liquid passage channel 12 of the heat conductor 1. The liquid then flows through the interior of the second end cover 4 into the second liquid passage channel 13 of the heat conductor 1. The liquid then leaves the second liquid passage channel 13, enters the second compartment 34 of the first end cover 3, and exits the heater out of the end cover water outlet 32 of the first end cover 3.

Figure 2:
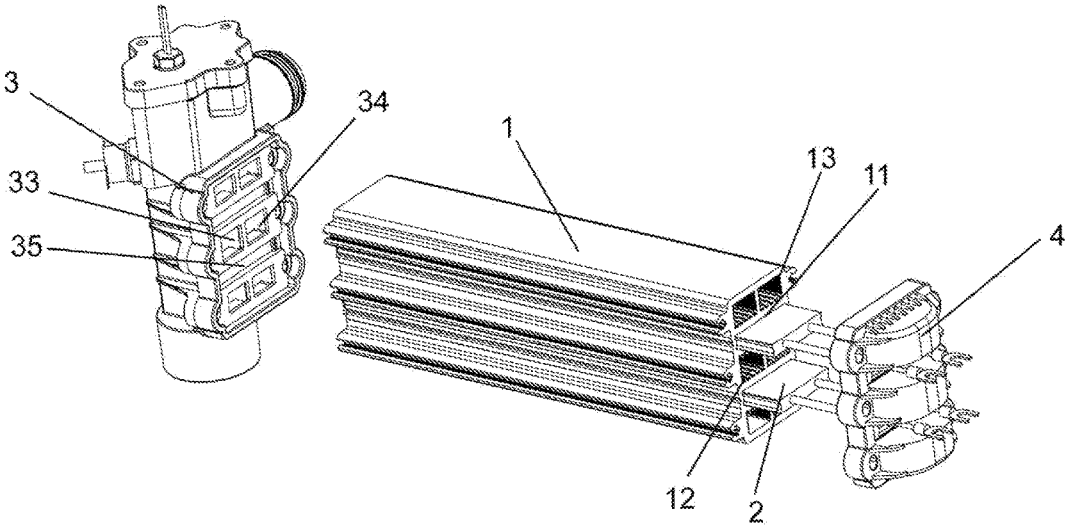
FIG. 2 is an exploded view of the PTC heater illustrated in FIG. 1.
Figure 3:
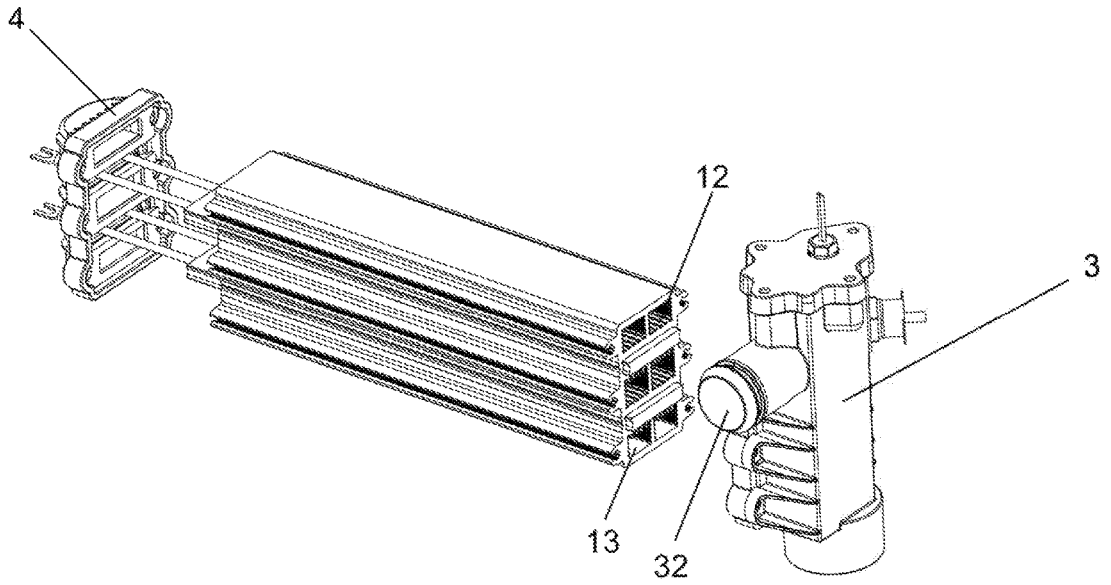
FIG. 3 is another exploded view of the PTC heater illustrated in FIG. 1.

According to this implementation, as best shown in FIG. 2, the first end cover 3 includes at least one groove 35 capable of accommodating a portion of the PTC heating element 2 extending out of the duct 11. The groove 35 extends through the first end cover 3 and is in communication with an external space (i.e., the atmospheric space outside of the PTC heater). Furthermore, a first sealing gasket 36 (FIG. 4) is interposed between an end face (FIG. 2) of the first end cover 3 and an end face (FIG. 3) of the heat conductor 1. The gasket 36 surrounds a mouth formed at one end of the first fluid passage channel 12 and the second fluid passage channel 13.

Figure 4:
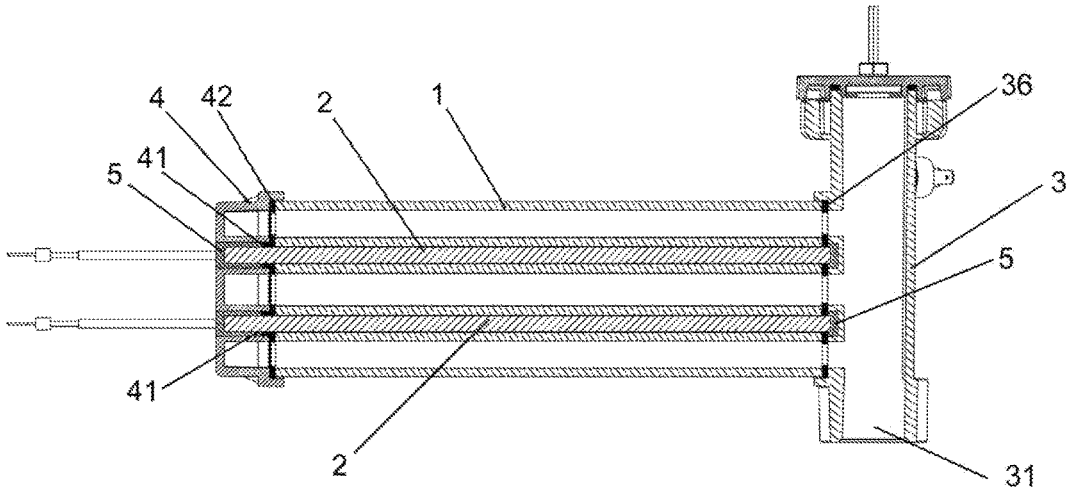
FIG. 4 is a cross-sectional view of the PTC heater illustrated in FIG. 1 showing the fluid communication between the end cover water inlet of the first end cover and the first liquid passage channel.
Figure 5:
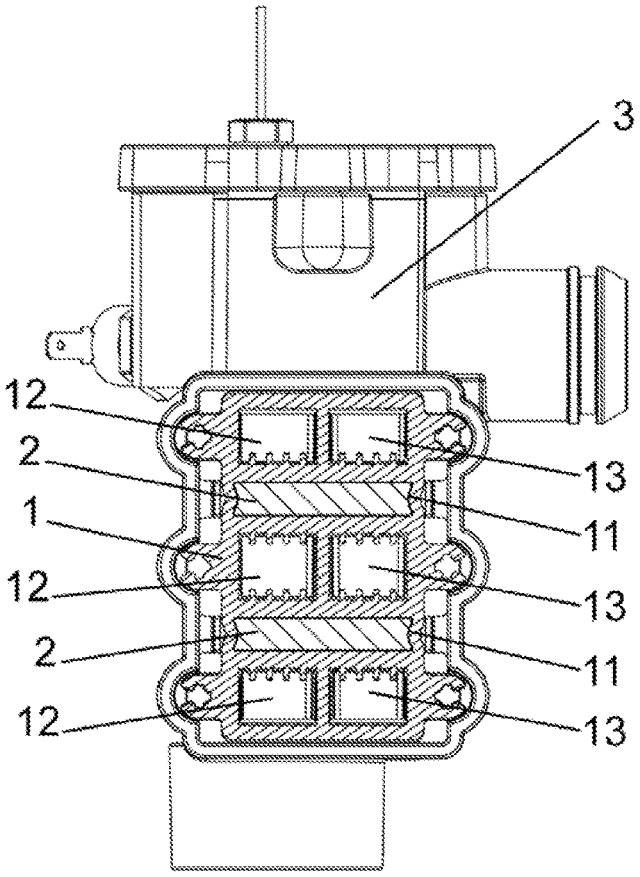
FIG. 5 is cross-sectional view of PTC heater illustrated in FIG. 1, taken across line 1-1.
Figure 6:
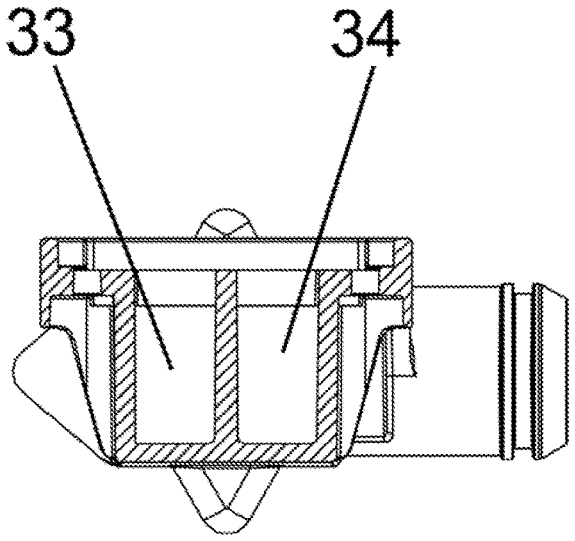
FIG. 6 is cross-sectional view of first end cover illustrated in FIG. 2, taken across line 2-2.
Figure 7:
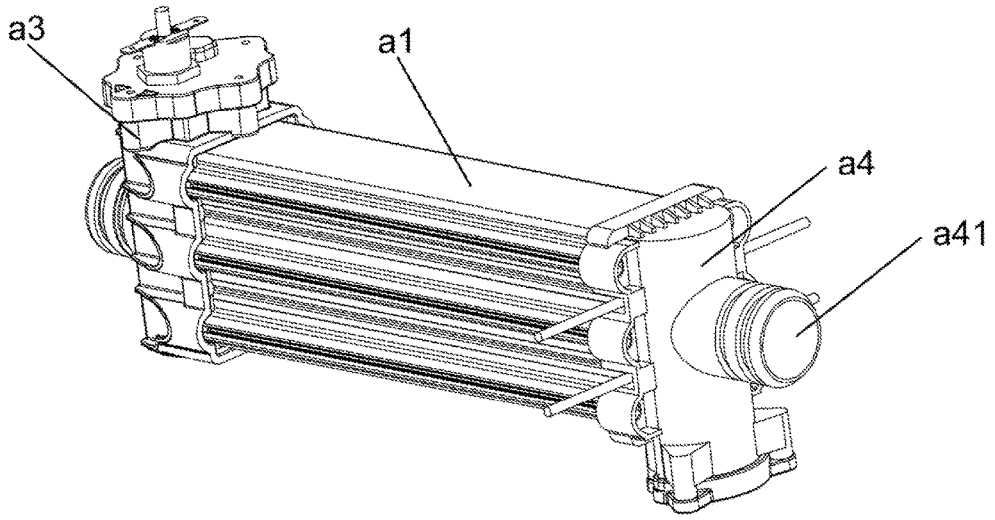
FIG. 7 is a perspective view illustrating a second example of an implementation of a PTC heater according to the present invention.

Similarly, as best shown in FIG. 4, the second end cover 4 also includes at least one opening 41 capable of accommodating an end of the PTC heating element 2 extending out of the duct 11. A second sealing gasket 42 is interposed between an end face (FIG. 3) of the second end cover 4 and an opposing end face (FIG. 2) of the heat conductor 1. The gasket 42 surrounds a mouth formed at an opposing end of the first fluid passage channel 12 and the second fluid passage channel 13.

In order to achieve better insulation, the portion of the PTC heating element 2 extending out of the duct 11 may be wrapped with an insulating and sealing layer 5 for protection. It may be preferred to fill an epoxy resin at the opening 41 of the second end cover 4 so as to wrap the exposed part of the PTC heating element 2 and form the insulating and sealing layer 5; however, in other implementations, depending on the application, a waterproof insulating rubber sheath, or insulating and sealing rubber plug may be used at the opening 41 of the second end cover 4 to provide insulation and sealing protection for the exposed portion of the PTC heating element 2. The above-mentioned insulating and sealing methods may effectively prevent leaking liquid from coming into contact with the PTC heating element 2, thereby avoiding an electrical leakage incident.

FIGS. 7-10 illustrate a second example of an implementation of a PTC heater according to the teaching of the present invention. The PTC heater includes a heat conductor a1, a first end cover a3, a second end cover a4, and at least one PTC heating element a2. The arrangement of the heat conductor a1 and the PTC heating element a2 are substantially the same as that described in the previous example.

Figure 8:
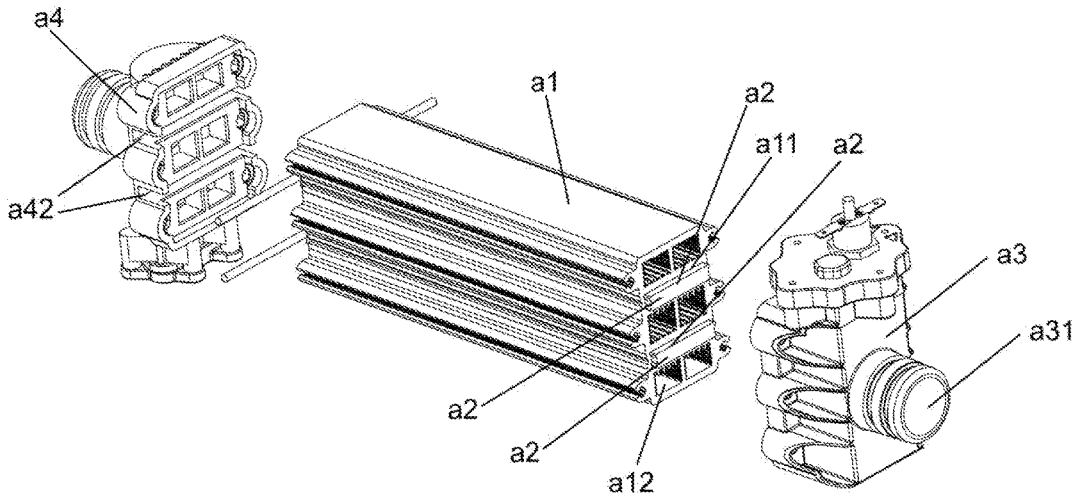
FIG. 8 is an exploded view of the PTC heater illustrated in FIG. 7.
Figure 9:
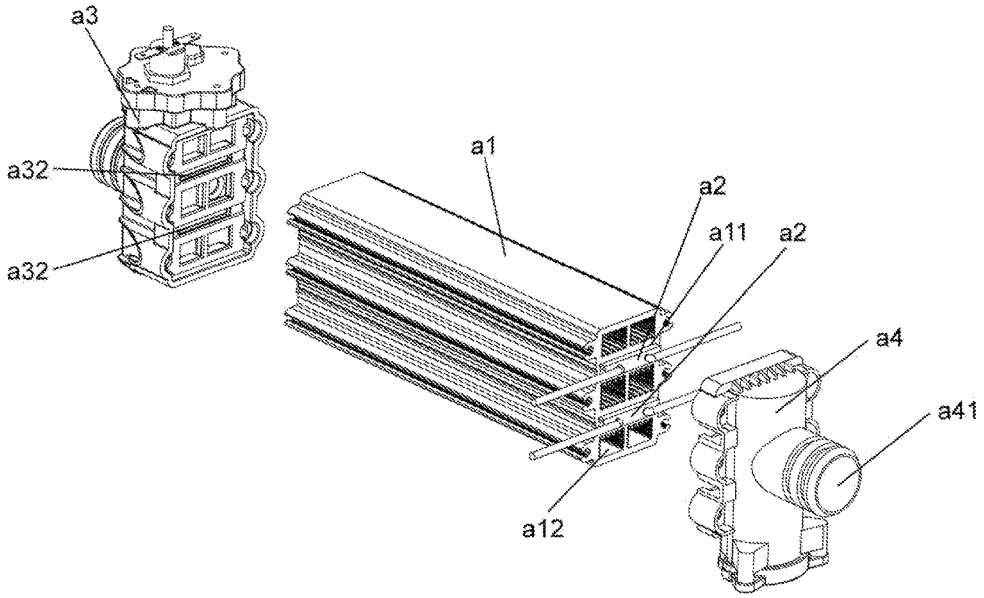
FIG. 9 is another exploded view of the PTC heater illustrated in FIG. 7.
Figure 10:
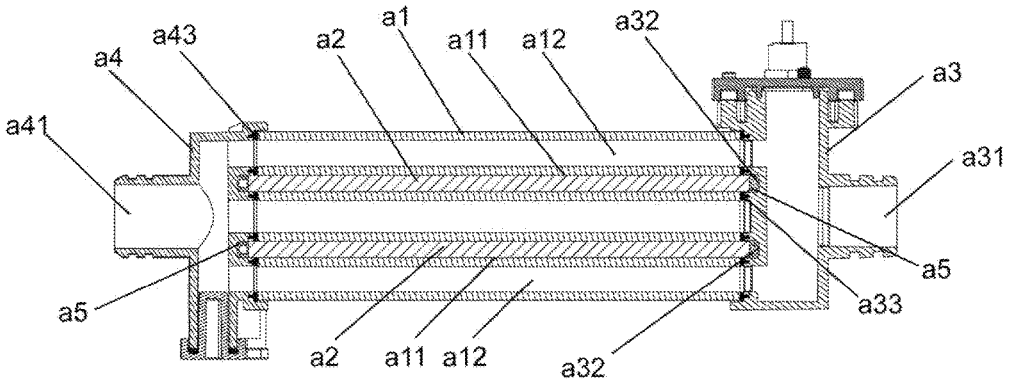
FIG. 10 is a cross-sectional view of the PTC heater illustrated in FIG. 1 showing the fluid communication between the end cover water inlet, the end cover water outlet and the liquid passage channels.

For instance, as best shown in FIG. 8, the heat conductor a1 may comprise an elongated, hollow aluminum member, internally provided with at least one duct a11 capable of accommodating the PTC heating element a2 and at least one liquid passage channel a12. The at least one duct a11 and the at least one liquid passage channel a12 both extend through an interior of the heat conductor a1. At least one PTC heating element a2 positioned within the duct a11 of the heat conductor a1 is fixed, by means of cold pressing and well butts, against an inner surface of the duct a11. In order to prevent electrical leakage due to contact between the PTC heating element a2 and a precipitant or liquid, the PTC heating element a2 may be constructed to a length longer than that of the heat conductor a1 such that at least one end of the PTC heating element a2 extends out of the duct a11 of the heat conductor a1. Two ends of the heat conductor a1 are fixedly coupled to the first end cover a3 and the second end cover a4, respectively. The first end cover a3 includes an end cover water inlet a31 in fluid communication with one end of the liquid passage channel a12. The second end cover a4 includes an end cover water outlet a41 (FIG. 7) in fluid communication with the opposite end of the liquid passage channel a12.

When the liquid is heated, the liquid flows from the end cover water inlet a31 of the first end cover a3, through the liquid passage channel a12 of the heat conductor a1, and out of the end cover water outlet a41 of the second end cover a4.

In this example, the first end cover a3 includes at least one first groove a32 (FIG. 9) capable of accommodating a portion of the PTC heating element a2 extending out of the duct a11. The first groove a32 extends through the first end cover a3 and is in communication with ambient space outside of the PTC heater. Furthermore, a first sealing gasket a33 (FIG. 10) is interposed between an end face (FIG. 9) of the first end cover a3 and an end face (FIG. 8) of the heat conductor a1, to surround a mouth formed at one end of the liquid passage channel a12.

Similarly, the second end cover a4 includes at least one second groove a42 capable of accommodating a portion of the PTC heating element a2 extending out of the duct a11. The second groove a42 extends width-wise through an interior of the second end cover a4 and is in communication with the external space. Furthermore, a second sealing gasket a43 is interposed between an end face (FIG. 8) of the second end cover a4 and an end face (FIG. 9) of the heat conductor a1, to surround a mouth formed at an opposite end of the liquid passage channel a12.

In order to achieve better insulation, the portion of the PTC heating element a2 extending out of the duct a11 may be wrapped with an insulating and sealing layer a5 for protection. It is preferable in the present embodiment to fill an epoxy resin at the first groove a32 of the first end cover a3 and the second groove a42 of the second end cover a4 so as to wrap the exposed part of the PTC heating element a2 to form an insulating and sealing layer a5. In addition to this, depending on the application, the insulating and sealing layer a5 may comprise a waterproof insulating rubber sheath, or an insulating and sealing rubber plug to provide an insulating and sealing protection for the exposed portion of the PTC heating element a2. The present implementation may effectively prevent leaking liquid from coming into contact with the PTC heating element a2, thereby avoiding the occurrence of an electrical leakage accident.

In summary, PTC liquid heaters of the present invention are characterized by constructing the length of the PTC heating element longer than that of the heat conductor so that at least one end of the PTC heating element extends from of the heat conductor. This causes the portion of the PTC heating element extending out of the heat conductor to be located at the outer side of the joining face of the two end covers and the heat conductor. Furthermore, the present invention is characterized by providing an insulating and sealing layer on the portion of the PTC heating element extending out of the duct for protection, thus achieving an enhanced insulating and sealing effect.

While described herein as being constructed of aluminum, the various components of the PCT heater may be constructed of stainless steel, plastic, alloy metal, or any other suitable non-corrosive material. Compared with prior art devices. PTC heaters of the present invention are advantageous because they include a protective layer that greatly reduces the risk of electrical leakage from the PTC heater, thereby providing high safety performance. Furthermore, PTC heaters according to the present invention comprise a simple structure and are effective in preventing an electrical leakage accident; thus, making them desirable to consumers.

In general, terms such as "coupled to," and "configured for coupling to," and "secured to," and "configured for securing to" and "in communication with" (for example, a first component is "coupled to" or "is configured for coupling to" or is "configured for securing to" or is "in communication with" a second component) are used herein to indicate a structural, functional, mechanical, electrical, signal, optical, magnetic, electromagnetic, ionic or fluidic relationship between two or more components or elements. As such, the fact that one component is said to be in communication with a second component is not intended to exclude the possibility that additional components may be present between, and/or operatively associated or engaged with, the first and second components.

The present invention has been described above in connection with example implementations which, however, are not intended to be limiting to the scope of the present invention, and any person skilled in the art could make possible changes and modifications without departing from the spirit and scope of the present invention. Hence, any alteration, equivalent change and modification which are made to the above-mentioned examples in accordance with the technical substance of the present invention and without departing from the spirit of the present invention, would fall within the scope defined by the claims of the present invention.

What is claimed is:

1. A heating unit for heating liquid, the heating unit comprising:

a PTC heating element having a first portion and a second portion, both the first portion and the second portion being configured to produce heat;

a heat conductor comprising a liquid passage channel, the heat conductor disposed between the PTC heating element and an interior of the liquid passage channel and the heat conductor conducting heat from the PTC heating element to the liquid, the heat conductor covering the first portion of the PTC heating element, wherein the heat conductor does not cover the second portion of the PTC heating element; and an end cover coupled to the heat conductor, the end cover having a space for accommodating the second portion of the PTC heating element.

2. The heating unit of claim 1, wherein the end cover has an internal passage channel for guiding a direction of the liquid.

3. The heating unit of claim 1, wherein the liquid passage channel is a first liquid passage channel, the heat conductor further comprises a second liquid passage channel, wherein the first portion of the PTC heating element is located between the first liquid passage channel and the second liquid passage channel.

4. The heating unit of claim 1, wherein the end cover is a first end cover, the heating unit further comprises a second end cover, the first end cover is coupled to a first end of the heat conductor, and the second end cover is coupled to a second end of the heat conductor.

5. A heating unit for heating liquid, the heating unit comprising:

a heat conductor having a liquid passage channel and a duct;

a PTC heating element having a first portion and a second portion, the first portion of the PTC heating element being located within the duct, the second portion of the PTC heating element being located outside of the duct, both the first portion and the second portion being configured to produce heat, and the second portion of the PTC heating element being wrapped with an insulating and sealing layer; and an end cover fixedly coupled to the heat conductor.

6. The heating unit of claim 5, wherein the liquid passage channel is a first liquid passage channel, the heat conductor further comprises a second liquid passage channel, and the portion of the PTC heating element is located between the first liquid passage channel and the second liquid passage channel.

7. The heating unit of claim 5, wherein a first sealing gasket is provided between an end face of the end cover and an end face of the heat conductor, and the first sealing gasket surrounds a mouth of the liquid passage channel.

8. The heating unit of claim 5, wherein a second sealing gasket is provided between an end face of a second end cover and a second end face of the heat conductor, and the second sealing gasket surrounds a mouth of the liquid passage channel.

9. A method for heating liquid, the method comprising:

providing a heat conductor having a liquid passage channel;

providing a PTC heating element; and heating a liquid passing through the liquid passage channel by the PTC heating element, wherein a portion of the PTC heating element extends out of the heat conductor, the portion being configured to produce heat, and the heat conductor disposed between the PTC heating element and an interior of the liquid passage channel and the heat conductor conducting heat from the PTC heating element to the liquid.

10. The method of claim 9, further comprising:

providing an internal passage channel in the heat conductor for guiding a direction of the liquid.

11. The method of claim 9, the liquid passage channel being a first liquid passage channel, the method further comprising:

providing a second liquid passage channel in the heat conductor; and disposing the PTC heating element between the first liquid passage channel and the second liquid passage channel.

12. The method of claim 9, the end cover being a first end cover, the method further comprising:

providing a second end cover;

coupling the first end cover to a first end of the heat conductor; and coupling the second end cover to a second end of the heat conductor.

13. The method of claim 12, further comprising:

providing a first sealing gasket between an end face of the first end cover and an end face of the heat conductor; and surrounding a mouth of the liquid passage channel with the first sealing gasket.

14. The method of claim 13, further comprising:

providing a second sealing gasket between an end face of the second end cover and an end face of the heat conductor; and surrounding a mouth of the liquid passage channel with the second sealing gasket.

* * * * *